US006783926B2

(12) United States Patent
Reece

(10) Patent No.: US 6,783,926 B2
(45) Date of Patent: Aug. 31, 2004

(54) CIRCUIT BOARD IC CARD CONNECTOR

(76) Inventor: Kenneth Reece, 3689 Alisos Rd., Arroyo Grande, CA (US) 93420

( * ) Notice: Subject to any disclaimer, the term of this patent is extended or adjusted under 35 U.S.C. 154(b) by 0 days.

(21) Appl. No.: 10/243,350

(22) Filed: Sep. 12, 2002

(65) Prior Publication Data

US 2003/0060085 A1 Mar. 27, 2003

Related U.S. Application Data

(60) Provisional application No. 60/322,532, filed on Sep. 15, 2001.

(51) Int. Cl.[7] ..... H01R 24/00

(52) U.S. Cl. ..... 430/630; 361/737; 235/492

(58) Field of Search ..... 439/630, 632, 439/680; 361/737; 235/441, 492

(56) References Cited

U.S. PATENT DOCUMENTS 5,744,713 A * 4/1998 Wienand et al. ..... 73/204.26
5,971,806 A * 10/1999 Evans et al. ..... 439/632
5,986,891 A * 11/1999 Sugimoto ..... 361/737
6,075,706 A * 6/2000 Learmonth et al. ..... 361/737
6,120,328 A * 9/2000 Bricaud et al. ..... 439/630
6,134,114 A * 10/2000 Ungermann et al. ..... 361/737
6,419,525 B1 * 7/2002 Heim et al. ..... 439/630
6,421,246 B1 * 7/2002 Schremmer ..... 361/737
6,494,745 B1 * 12/2002 Schremmer ..... 439/630
6,561,851 B2 * 5/2003 Florescu ..... 439/630
6,607,404 B1 * 8/2003 Ito et al. ..... 439/630
2001/0053634 A1 * 12/2001 Camacho ..... 439/630

* cited by examiner

*Primary Examiner*—Michael C. Zarroli

(57) ABSTRACT

A device for establishing electrical connection between at least one contact pad on an integrated circuit (IC) card and corresponding conductive elements of a printed circuit board (PCB) having a plurality of evenly aligned brush contacts comprised in the PCB. An optional housing is adapted to apply pressure to the inserted card to press the contact pad of said card against the contacts comprised in the PCB.

Each contact comprised in the PCB comprises a contact leg and a contact head that is attached to an open end of said contact leg. The contact legs are created and made flexible by removing unwanted parts of the PCB thus creating desired gaps between said contact legs. The contact head is created by attaching a conductor to the open end of a contact leg.

The housing and the PCB together define a card insertion plane therebetween having a card insertion ingress at a front boundary thereof.

14 Claims, 24 Drawing Sheets

CIRCUIT BOARD IC CARD CONNECTOR

CROSS-REFERENCE TO RELATED APPLICATION

This application is entitled to the benefit of Provisional Patent Application ser. 60/322,532 filed Sep. 15, 2001.

FEDERALLY SPONSORED RESEARCH

Not Applicable

SEQUENCE LISTING OR PROGRAM

Not Applicable

BACKGROUND—FIELD OF INVENTION

The present invention relates generally to an apparatus that electrically connects an integrated circuit (IC) card to a printed circuit board (PCB), specifically to an IC card read/write device comprised in the PCB thereby obtaining a low profile above the PCB.

BACKGROUND—TERMINOLOGY

In the context of the invention, "card" means all types of cards of the kind incorporating a hybrid or monolithic integrated circuit or "microchip". The term "microcircuit" will be used hereinafter.

The term "card" is also used to describe a microchip by itself or integrated with other objects. Examples of such objects are credit cards, memory cards, SIM cards used in cellular phones, keys or key-rings. The term "card" is further used to describe the microchip integrated with any other object than those mentioned in the example.

In this disclosure, the terms "IC card", "chip card", "smart card" and "card" will be used interchangeably to denote integrated circuit cards of this type.

The term "printed circuit board" or "PCB" is used to describe any type of circuit board with interconnecting conductors, regardless of the method used to manufacture said circuit board.

The microcircuit is usually based on a microprocessor or a microcontroller including memory circuits, for example of the "PROM" or "EEPROM" type. It must be possible to insert this type of card into dedicated devices for reading and/or writing data. For the sake of simplicity, this device will be referred to as a "reader" hereinafter, it being understood that it can equally write data and perform other ancillary functions (such as electrical power supply, tests) referred to hereinafter. The data is stored in the aforementioned memory circuits, usually in encrypted form. It is therefore read from memory locations or written to memory locations.

Other logical architectures are used in particular for "electronic purse" or similar type applications.

In all cases there are input-output members in the form of contact areas, also known as "pads", flush with the surface of one of the principal faces of the card. Various standards (ISO, AFNOR, etc.) define the position of these contact areas. They are used not only for the aforementioned data inputs-outputs but also to supply electrical power to the microcircuit and to enable various checks to be carried out, according to the applications concerned (presence test, etc.).

BACKGROUND—DESCRIPTION OF PRIOR ART

Demand for Improved Security

In correlation with an increasing demand for secure transactions and the need for increased security in regard to electronic payments and network access, the electronic industry has seen growth in the use of cards incorporating a microcircuit commonly referred to as Integrated Circuit (IC) cards.

Demand for Smaller Multifunction Devices

At the same time there has been an increasing demand for diminutive electronic devices capable of multipurpose performance, such as cellular phones with Internet access, PDA's, handheld PC's, MP3 players and many other products.

Description of Smart Cards

These IC cards are also commonly referred to as "smart cards" and incorporate at least one electronic component to which a link must be established, either through an electrical connection (hereinafter called contact smart cards) or through a wireless connection (hereinafter called contactless smart cards).

Contact smart cards traditionally are formed of a plastic plate having about the same thickness as a credit card, with an integrated circuit imbedded in the plastic and with contact pads on a surface of the card. Such cards come in different sizes, with the large size commonly being about the size of a credit card and with a popular small size being referred to as a MICROSIM or simply SIM card.

Description of Link Between Card and PCB

The contact smart cards are inserted into connectors that make contact between the contact pads of the card and a plurality of contacts comprised in the connector to establish an electrical connection to the electronic components of a printed circuit board (PCB).

Common Uses of Smart Cards

Smart cards are particularly adapted for use in industries requiring strict access or billing control and convenient as well as secure access to money and information. Such applications include public phones, vending machines, copy machines, laundromat machines, public transportation ticketing and portable devices such as cellular phones, pagers, PDAs, laptop computers and other similar electronic devices and also stationary devices such as a PC, a satellite receiver or a telephone. Such cards can also be used in applications relating to payments, loyalty programs, citizen cards, electronic elections, health services, ticketing, security access and machine controls.

The cards are commonly used to authorize transactions such as purchases of goods, for access control, for identification purposes, and to allow operation of an automobile radio. Use of smart cards for secure identity authentication purposes and for online payment transactions over the Internet are increasing.

Introduction of the Object of a Smart Card Reader

In order to effect electrical connection between a smart card and a PCB, an electrical connector or smart card reader is employed such that the connector securably accommodates the smart card therein. The connector serves as an interface between a smart card and a reading system that interprets the information contained in the card.

It is desirable that the connector be of small size and be constructed of a minimal number of parts.

Introduction of Prior Art

The art has utilized numerous electrical connectors specifically designed for use in removably connecting various types of IC cards.

See the following U.S. Patents, each of which is incorporated herein by reference:

| Inventor | Pat. No. |
|---|---|
| Schuder, et al. | 6,283,376 |
| Wu, et al. | 6,280,254 |
| Yasufuku, et al. | 6,278,610 |
| Bohm | 6,275,383 |
| Nishioka | 6,267,619 |
| Heim, et al. | 6,261,128 |
| Chen | 6,261,113 |
| Neifer | 6,250,965 |
| Heim | 6,244,911 |
| McDowell, et al. | 6,244,902 |
| Beun, et al. | 6,243,273 |
| Reichardt | 6,241,557 |
| Bricaud, et al. | 6,241,545 |
| Ogura, et al. | 6,238,248 |
| Somerville, et al. | 6,234,844 |
| Odic | 6,231,395 |
| Schnell, et al. | 6,231,394 |
| Kaneko | 6,227,893 |
| Simmel, et al. | 6,220,882 |
| Hoolhorst, et al. | 6,210,233 |
| Fukuda | 6,206,732 |
| Chen | 6,206,710 |
| King | 6,200,166 |
| Luvini, et al. | 6,193,557 |
| Lim | 6,179,638 |
| Klatt, et al. | 6,176,724 |
| Sakata, et al. | 6,176,723 |
| Gottardo, et al. | 6,176,721 |
| Martucci | 6,174,188 |
| Yamagami, et al. | 6,174,187 |
| Benjamin, et al. | 6,168,082 |
| Bourne | 6,165,021 |
| Chang | 6,159,051 |
| Bernardet, et al. | 6,159,028 |
| Bricaud, et al. | 6,149,466 |
| Berg, et al. | 6,149,465 |
| Gastineau | 6,149,450 |
| Chang | 6,146,195 |
| Berg, et al. | 6,142,802 |
| Seeley, et al. | 6,132,223 |
| Chang | 6,129,588 |
| Ikemoto | 6,129,571 |
| Kihira, et al. | 6,129,558 |
| Chang | 6,126,486 |
| Lyons | 6,123,456 |
| Bricaud, et al. | 6,120,328 |
| Babineau, et al. | 6,115,263 |
| Hyland | 6,112,994 |
| Wood, et al. | 6,107,122 |
| Michaelis, et al. | 6,106,317 |
| Lotz | 6,105,872 |
| Haffenden, et al. | 6,102,743 |
| Kusakabe, et al. | 6,102,723 |
| Kubo | 6,101,372 |
| Wu | 6,099,353 |
| Hyland, et al. | 6,095,868 |
| Nishioka | 6,089,919 |
| Chang | 6,086,426 |
| Lescoat | 6,086,425 |
| Chang | 6,086,424 |
| Lotz | 6,086,423 |
| Wienand, et al. | 6,079,265 |
| Zuin | 6,068,514 |
| Davis, et al. | 6,062,911 |
| Hyland, et al. | 6,062,889 |
| Schuster, et al. | 6,062,887 |
| Pollock, et al. | 6,056,601 |
| Nishioka | 6,056,573 |
| Bricaud, et al. | 6,053,776 |
| Ungermann, et al. | 6,053,775 |
| Lok | 6,050,857 |
| Helmstetter, et al. | 6,046,913 |
| Benjamin, et al. | 6,039,599 |
| Hyland | 6,024,593 |
| Fuchs, et al. | 6,004,168 |
| Reichardt, et al. | 6,000,969 |
| Chang | 5,997,356 |

-continued

| Inventor | Pat. No. |
|---|---|
| Inadama | 5,997,345 |
| Akama, et al. | 5,997,315 |
| Klatt, et al. | 5,993,261 |
| Iguchi | 5,993,232 |
| Chan, et al. | 5,991,158 |
| Sugimoto | 5,986,891 |
| Berg, et al. | 5,980,324 |
| Bricaud, et al. | 5,980,323 |
| Kanda, et al. | 5,980,294 |
| Ichimura | 5,980,277 |
| Joly | 5,975,959 |
| Korsunsky, et al. | 5,969,330 |
| Vallat | 5,969,329 |
| Wu, et al. | 5,961,338 |
| Ichimura | 5,954,530 |
| Ichimura | 5,951,315 |
| Vallat | 5,945,662 |
| Yu | 5,941,723 |
| Roelofs, et al. | 5,926,365 |
| Sato, etal. | 5,906,516 |
| Nixon | 5,883,786 |
| Bricaud, et al. | 5,882,230 |
| Takemura | 5,850,103 |
| Bricaud, et al. | 5,823,828 |
| Delprete, et al. | 5,820,391 |
| Brioaud, et al. | 5,800,200 |
| Bricaud, et al. | 5,775,949 |
| Hashiguchi | 5,775,929 |
| Kwiat, et al. | 5,746,626 |
| Bricaud, et al. | 5,746,607 |
| Wienand, et al. | 5,744,713 |
| Kaneshige, et al. | 5,743,766 |
| Verstijnen | 5,733,147 |
| Braun, et al. | 5,718,609 |
| Brunker, et al. | 5,713,764 |
| Sakata, et al. | 5,695,353 |
| Takemura | 5,674,080 |
| Broschard, III, et al. | 5,667,408 |
| Broschard, III, et al. | 5,667,397 |
| Broschard, III | 5,653,610 |
| Nishio, et al. | 5,639,265 |
| Kinross | 5,620,342 |
| Broschard, III | 5,599,203 |
| Duke, et al. | 5,595,505 |
| Braun | 5,586,890 |
| Stipanuk, et al. | 5,580,267 |
| Sarradin | 5,574,271 |
| Mizuguchi | 5,567,171 |
| Matsushita, et al. | 5,489,216 |
| Chishima, et al. | 5,474,468 |
| Kessoku, et al. | 5,473,505 |
| Schwan, et al. | 5,470,260 |
| Bellomo, et al. | 5,449,297 |
| Thrush, et al. | 5,425,651 |
| Pickles | 5,423,691 |
| Casses | 5,395,259 |
| Hania, et al. | 5,380,997 |
| Kinross, et al. | 5,366,390 |
| Someno | 5,325,269 |
| Reichardt, et al. | 5,320,552 |
| Imai | 5,316,496 |
| Defrasne | 5,286,957 |
| Dewey, et al. | 5,286,215 |
| Thompson | 5,281,148 |
| Ozouf, et al. | 5,276,317 |
| Reichardt, et al. | 5,269,707 |
| Tseng, et al. | 5,268,820 |
| Schuder, et al. | 5,259,777 |
| Pernet | 5,252,815 |
| Duffet, et al. | 5,224,873 |
| Arai, et al. | 5,211,571 |
| Fuchs | 5,209,669 |
| Anderson, Jr., et al. | 5,205,738 |
| Martin, et al. | 5,198,645 |
| Tanuma, et al. | 5,196,994 |
| Kaneda, et al. | 5,184,282 |
| Pernet | 5,169,345 |

-continued

| Inventor | Pat. No. |
|---|---|
| Licht, et al. | 5,163,854 |
| Birch | 5,161,992 |
| Zaderej, et al. | 5,156,552 |
| Kiat-Hup, et al. | 5,154,644 |
| Ichitsubo | 5,110,309 |
| Mouissie | 5,106,307 |
| Grabbe, et al. | 5,104,324 |
| Takahashi | 5,091,618 |
| Biechler, et al. | 5,052,936 |
| Collier | 5,040,991 |
| Piorunneck, et al. | 5,035,631 |
| Gordon, et al. | 5,013,263 |
| Juret, et al. | 5,013,255 |
| Pernet | 5,012,078 |
| Komatsu | 5,000,694 |
| Buck, et al. | 4,997,376 |
| Billman, et al. | 4,973,270 |
| Yamamoto | 4,968,266 |
| Tkazyik, et al. | 4,941,830 |
| Ichitsubo | 4,932,904 |
| Scholz | 4,932,885 |
| Seidler | 4,932,876 |
| O'Brien | 4,921,453 |
| Anhalt, et al. | 4,919,626 |
| Knight | 4,915,636 |
| Walton, et al. | 4,911,653 |
| Ohkubo, et al. | 4,909,742 |
| Maillot | 4,902,233 |
| Pernet | 4,900,273 |
| Lange, et al. | 4,900,272 |
| Dranchak, et al. | 4,892,487 |
| Andrews Jr. | 4,869,672 |
| Matsuoka | 4,846,713 |
| Shino | 4,843,223 |
| Yasuma, et al. | 4,839,509 |
| Fujii | 4,820,186 |
| Komatsu | 4,810,203 |
| Kniese, et al. | 4,806,103 |
| Owen | 4,795,354 |
| Thrush | 4,781,612 |
| Hamada | 4,780,603 |
| Berg, et al. | 4,780,087 |
| Reichardt, et al. | 4,752,234 |
| Krumme | 4,734,047 |
| Owen | 4,726,775 |
| Mouissie | 4,721,348 |
| Beers | 4,720,156 |
| Sitzler | 4,705,338 |
| Mouissie | 4,701,002 |
| Hvezda, et al. | 4,700,998 |
| Grabbe, et al. | 4,695,111 |
| Massit, et al. | 4,684,181 |
| Dunn, et al. | 4,682,834 |
| Moore | 4,678,252 |
| Stipanuk, et al. | 4,665,614 |
| Furuya | 4,662,702 |
| Kikuchi, et al. | 4,645,277 |
| Krumme | 4,643,500 |
| Sonobe | 4,636,022 |
| Crawford | 4,634,210 |
| Andrews, Jr., et al. | 4,629,270 |
| Boland | 4,598,966 |
| Zrnich | 4,561,711 |
| Olsson | 4,560,221 |
| Noschese | 4,556,268 |
| Lapraik, et al. | 4,553,804 |
| Lapraik, et al. | 4,553,803 |
| Ruehl | 4,553,802 |
| Grabbe, et al. | 4,550,959 |
| Gillett | 4,548,452 |
| Gillett, et al. | 4,542,950 |
| Lumpp | 4,541,678 |
| Steele | 4,540,228 |
| Petit, et al. | 4,469,385 |
| Porter | 4,448,466 |
| Weber | 4,403,819 |
| Endoh, et al. | 4,385,795 |

-continued

| Inventor | Pat. No. |
|---|---|
| Mears | 4,142,226 |
| Sugimoto, et al. | 4,129,351 |
| Andreaggi | 4,113,342 |
| Ostapovitch | 4,070,557 |
| Benasutti | 4,026,627 |
| Vladic | 4,003,625 |
| Sherwood | 3,997,231 |
| BonHomme | 3,517,374 |
| Miller | 3,474,380 |
| Bird | 3,315,217 |
| Tuchel | 3,289,146 |
| Paholek, et al. | 3,234,499 |
| Fedder, et al. | RE32,559 |

FIG. 1.

An illustrative example of a conventional smart card reader is provided in FIG. 1, wherein a smart card connector 10 includes a housing 12 fabricated from an insulative plastic material and having a top portion 12*a* and a bottom portion 12*b* having dimensions circumscribed by a peripheral side wall 12*c*. Top portion 12*a* and bottom portion 12*b* together define a linear card insertion slot 14 having ingress 14*a* through which a smart card enters connector 10. Ingress 14*a* is generally sized and shaped to correspond to a smart card that is inserted therethrough.

Bottom portion 12*b* supports a plurality of electrical contacts 16 for electrical engagement with a contact pad of a smart card inserted thereagainst. Contacts 16 lie outwardly from a mid-section of bottom portion 12*b* and have tail portions 16*a* that extend normally relative to peripheral wall 12*c*. Bottom portion 12*b* further includes one or more securement members 18 protruding from a bottom surface thereof for alignment and securement of connector 10 with a PCB. In order to ensure sufficient termination of contacts 16 to the PCB, bottom portion 12*b* is positioned flush therewith.

Description of Why the Connector in FIG. 1 Needs Improvements

Although the aforedescribed connector effectively establishes electrical contact between a smart card and a PCB, its use may not be desirable in configurations where conservation of materials and space is essential. The above design requires at least two housing portions wherein one portion must provide enough space for support of a requisite number of electrical contacts therein.

Such configuration will as a minimum require space above the PCB equal to the sum of the height of the bottom portion (12*b*) plus the height of the ingress 14 plus the height of the top portion (12*a*).

A major component of manufacturing costs is often related to the number of manufacturing and assembly operations, the latter being particularly time consuming. This configuration further comprises relatively complicated mechanical design which is contributing to increased costs associated with the manufacture of such reading devices.

Objects and Advantages

Explanation of the Need for the Invention

There is a continuous demand to reduce the size of electrical and electronic components and also to reduce their cost.

Thus, it is desirable to provide a smart card connector that establishes electrical communication between a smart card and a PCB while minimizing the required space above the PCB for integration into diminutive devices.

It is further desirable to provide a smart card connector that implements a simple contact configuration so as to effect a satisfactory electrical connection in a manner that reduces the cost and complications of the manufacture of such device.

Advantages

From the description above, a number of advantages of the present invention becomes evident:

A) When punching out a portion of the PCB to create the contact legs, said contact legs are effectively made completely flush with the PCB, thus creating the smallest possible profile above the PCB to save valuable space.

B) The use of the PCB as the contacts, make it possible to avoid the inclusion of a separate smart card connector when manufacturing a smart card read/write device.

C) Any suitable material can be used for the housing, which make it possible to adapt other devices to function as the housing of the present invention. An example of such a device is a display that can easily be adapted to function as the housing of the present invention.

D) By re-using the punched out portions of the PCB of one embodiment of the invention, as the bottom portion of other smaller embodiments of the invention, 2 or more read/write devices can be created from the same PCB that would otherwise be used to create only 1 connector. This enables a more cost effective manufacturing process.

E) The contact heads that are created by attaching a convex shaped metal piece onto the contact legs are considerably simpler to manufacture than the relatively complicated mechanical design of the contacts of connectors of the prior art.

F) The low profile of the present invention makes the device easily integratable with other devices with diminutive features.

SUMMARY

In accordance with the present invention a PCB and a housing attached to said PCB form an IC card connector comprising a plurality of brush data contacts that make galvanic contact with the contact pad of a correctly inserted card.

The brush contacts are created by punching out an unwanted part of the PCB, thus creating a gap between said contacts to make them flexible. The housing that is attached to the PCB is made of a suitable material that is adapted to form the top portion of a card insertion slot, with the PCB forming the bottom portion of said card insertion slot.

The housing is formed in such a way that part of the inner side of the housing has a convex shaped pressure area that applies pressure to an IC card when said card is inserted into the card insertion slot.

When an IC card is fully and correctly inserted into the card insertion slot, contact is made between the contacts comprised in the device and a contact pad on said IC card.

In the configuration according to the present invention, the reader can be made very thin which will preserve valuable space above the PCB and allow the device to be integrated into other devices that requires thin features, for example (but not limited to) cellular phones, PDAs, pagers, automobile music devices, mouse pads, displays and keyboards. Also the reader by itself form a diminutive portable smart card read/write device.

DRAWINGS

Drawing Figures

REFERENCE NUMERALS IN DRAWINGS

Figure 1:
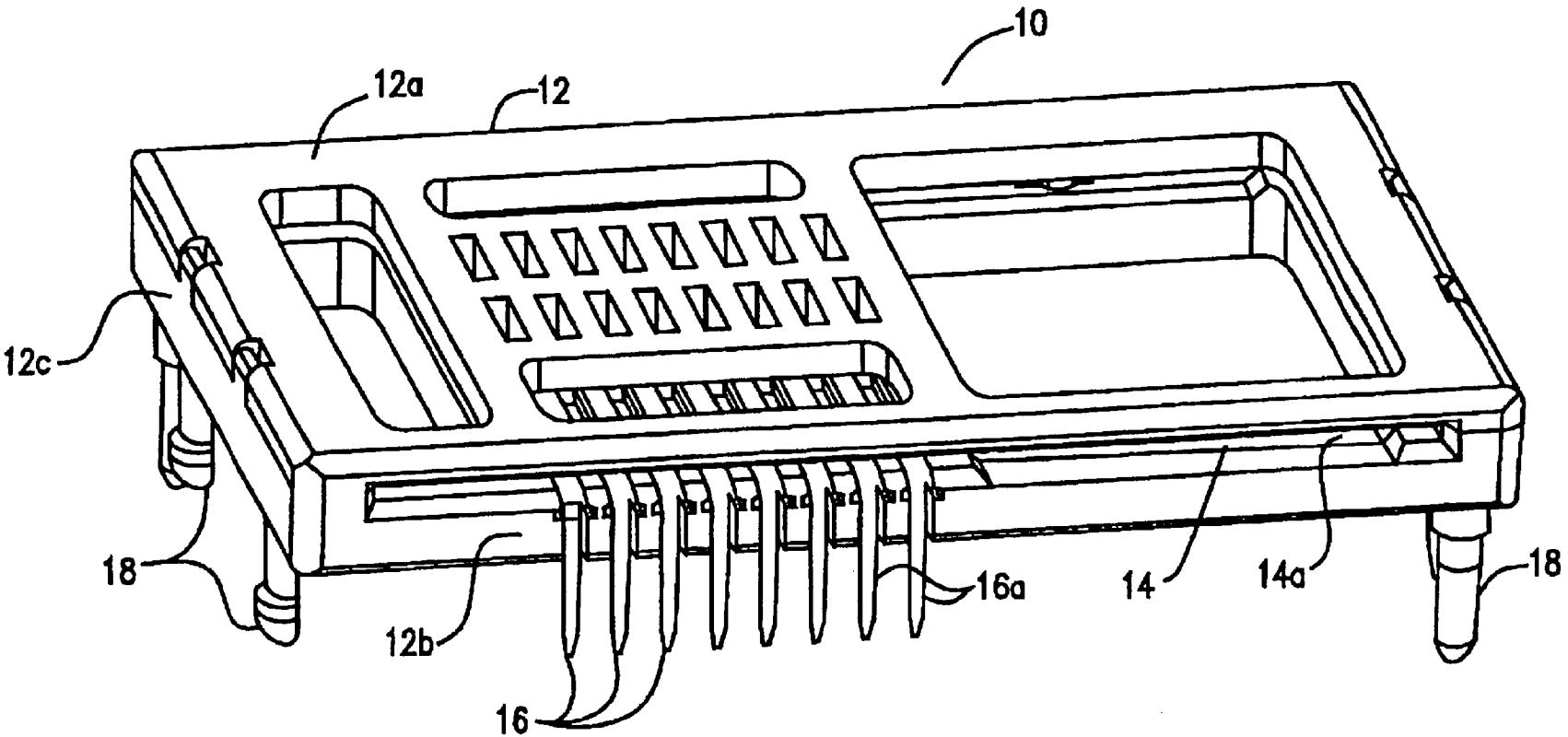
(PRIOR ART) FIG. 1
FIG. 1 illustrates a front perspective view of a smart card connector of the prior art having a plurality of electrical contacts supported in a bottom portion of the connector housing.

FIG. 1. (Prior Art)

10 Smart card connector
12 Housing for smart card connector
12*a* Top portion of housing 12
12*b* Bottom portion of housing 12
12*c* Peripheral wall
14 Card insertion plane
14*a* Card insertion ingress
16 Electrical contacts
16*a* Tail portion of electrical contacts 16
18 Securement members

FIGS. 2–14

20 Card read/write device
22*a* Housing—Top portion of card read/write device 20
22*b* Printed Circuit Board (PCB)—Bottom portion of card read/write device 20
22*c* Space on PCB for components
22*d* Divider
22*e* Side edges
22*f* End edge
24 Card insertion plane
24*a* Card insertion ingress
24*b* Convex shaped pressure area
24*c* Half Circle cut out of housing 22*a* for easy insertion and extraction a card
24*d* Opening in housing 22*a* on 3 sides of pressure-area 24*b*
25*a* Side edge of housing 22*a*
25*b* Side edge of housing 22*a* opposite side edge 25*a*
25*c* End edge of housing 22*a*
26 Electrical contacts comprised in PCB 22*b*
26*a* Contact leg
26*b* Contact head
26*c* Half circle cut out of PCB for easy extraction of inserted card
27 Opening in PCB 22*b* to create contact legs 26*b*
28 Flexible pressure area with spring effect
30 Integrated Circuit (IC) Card
32 Contact pad of IC card 30
34 Data display
36 Navigation buttons
38 Alphanumeric keypad
40 Integrated circuit (IC) contact-less card
40*a* Top layer of contact-less card 40
40*b* Bottom layer of contact-less card 40
40*c* Integrated circuit chip of contact-less card 40
40*d* Antenna of contact-less card 40
42 Path on PCB 22*b* for communication with contact-less card 40

DETAILED DESCRIPTION

Figure 2:
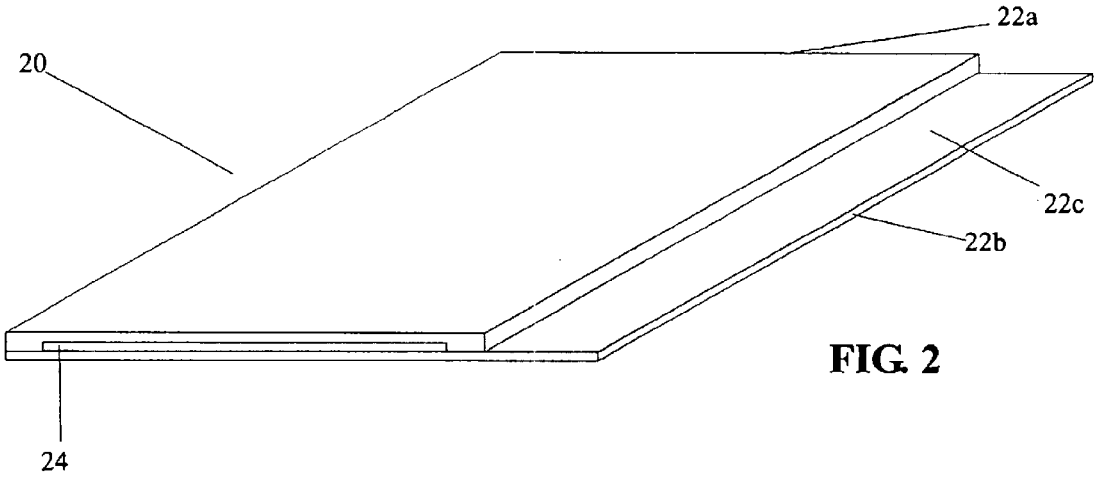
FIG. 2 illustrates a front perspective view of a card read/write device of the present invention in a preferred embodiment.
Figure 3:
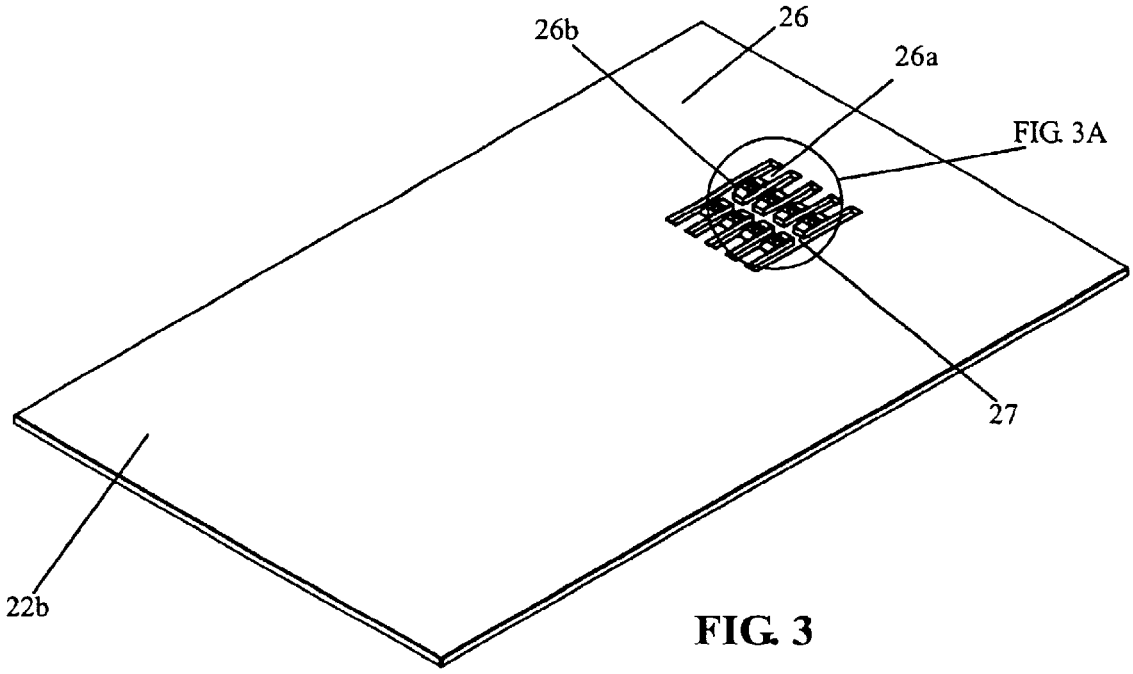
FIG. 3 illustrates a front perspective view of the bottom part of the card read/write device of FIG. 2 that shows a printed circuit board (PCB) comprising a plurality of electrical contacts.
Figure 3A:
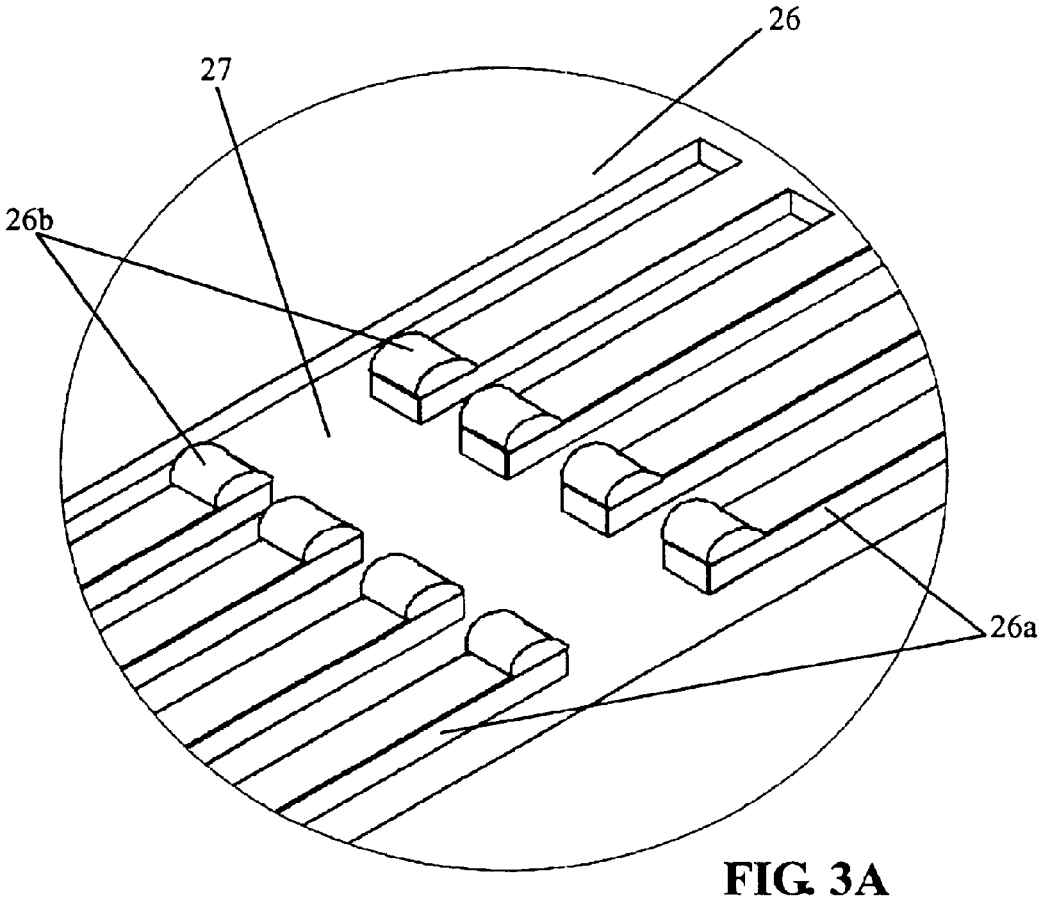
FIG. 3A illustrates a close-up of the electrical contacts of FIG. 3.

FIGS. 2–3A Preferred Embodiment

The present invention provides for an Integrated Circuit (IC) card read/write device (hereinafter called the connector) that establishes an electrical connection between at least one contact pad on the card and corresponding conductive elements of a printed circuit board (PCB).

Figure 2A:
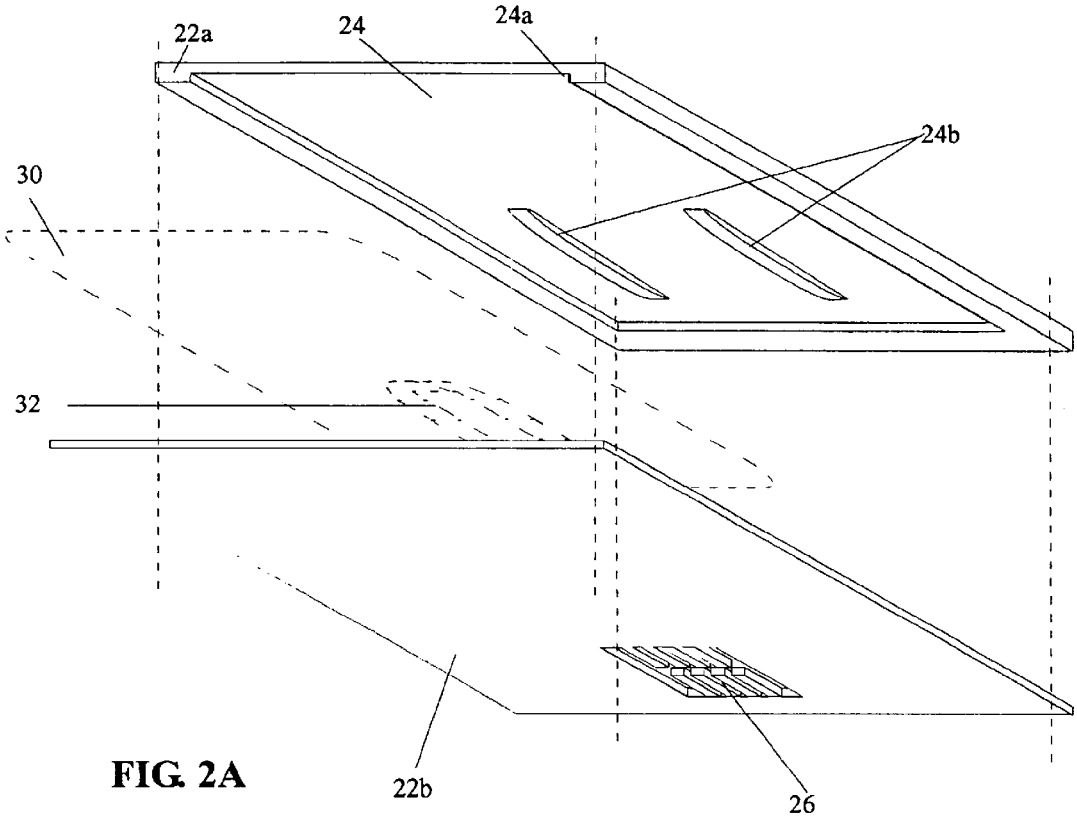
FIG. 2A illustrates an exploded rear perspective view from below of an IC card being inserted into the card read/write device of FIG. 2.
Figure 2B:
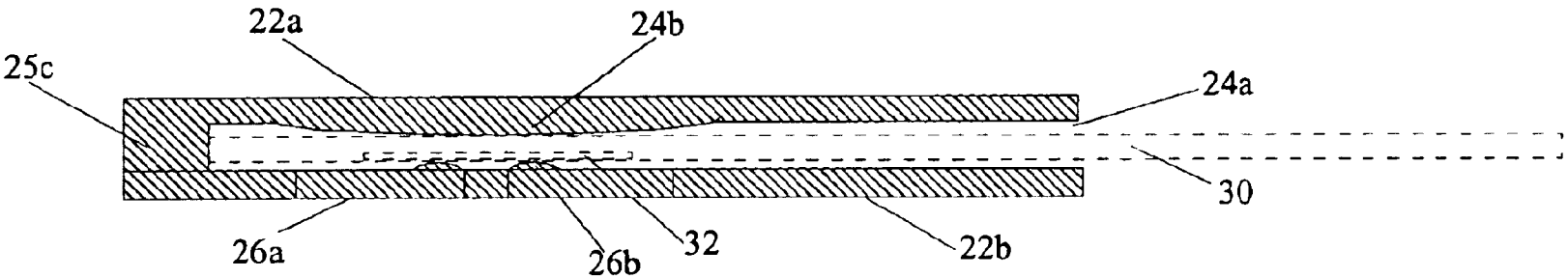
FIG. 2B illustrates a cross sectional view of an embodiment of the read/write device of FIG. 2A with a card inserted, along line A—A of FIG. 2A.

A preferred embodiment of the connector is illustrated in FIG. 2 (front perspective view) and FIG. 2A (exploded rear perspective view from below).

The connector has a top portion 22*a* (the housing) and a bottom portion 22*b* (the PCB) that together define a card insertion plane 24 therebetween having a card insertion ingress 24*a* at a front boundary thereof.

In the preferred embodiment as illustrated in FIG. 2, the connector is adapted to communicate with IC cards of the regular credit card size. In other embodiments of the present invention the connector can be adapted to communicate with any other types of IC cards, by varying the size and shape of the housing and the PCB.

The Housing

The top portion of the device of the present invention (hereinafter called the housing) in the preferred embodiment is fabricated from an insulative plastic material.

The housing is injection molded in such a way, that the inner side of the housing comprise a number of convex shapes 24*b* (hereinafter called pressure areas) that are slightly offset from the housing plane (approximately 0.5–1.0 mm).

Three 25*a*, 25*b* and 25*c* of the housing 24*d* form a frame on three sides of an inserted card 30. Said edges functions like a guide when the card is inserted into the card insertion ingress 24*a*. The end edge of said frame (25*c*) opposite from the card insertion ingress (24*a*) prevents the card from being inserted too deep into the connector.

When an IC card 30 is inserted into the card insertion ingress 24*a*, the pressure areas 24*b* applies pressure to the card and force the card downward, creating a connection between the contact pad on the IC card 32 and the contact heads 26*b* of the electrical contacts 26 of the bottom portion of the connector 22*b*.

Optionally an opening 24*d* in the PCB 22*b* can be created around at least 2 sides of said pressure area 24*b*, to make said pressure areas flexible. This feature is illustrated in FIG. 5A.

The housing can be attached to the PCB in a plurality of ways. One simple way is to glue or solder the housing to the PCB. Another example is to comprise a number of vertical spikes along the edge of the housing, with the spikes having the same length as the height of the PCB. These spikes will then fit into a number of holes drilled along the edge of the PCB for the purpose of attaching the housing to the PCB as described.

The PCB

The bottom portion 22*b* of the connector 20 is a printed circuit board (PCB) that comprises a plurality of electrical contacts 26 in even, aligned distribution therein so as to effect electrical engagement between the contacts and at least one contact pad 32 on the IC card 30.

A contact 26 comprises a contact leg 26*a* and a contact head 26*b*.

The contact legs are comprised in the PCB with 1 closed end and 1 open end. Said contact legs are created by punching out a portion 27 of the PCB to create a flexible open end.

Figure 4:
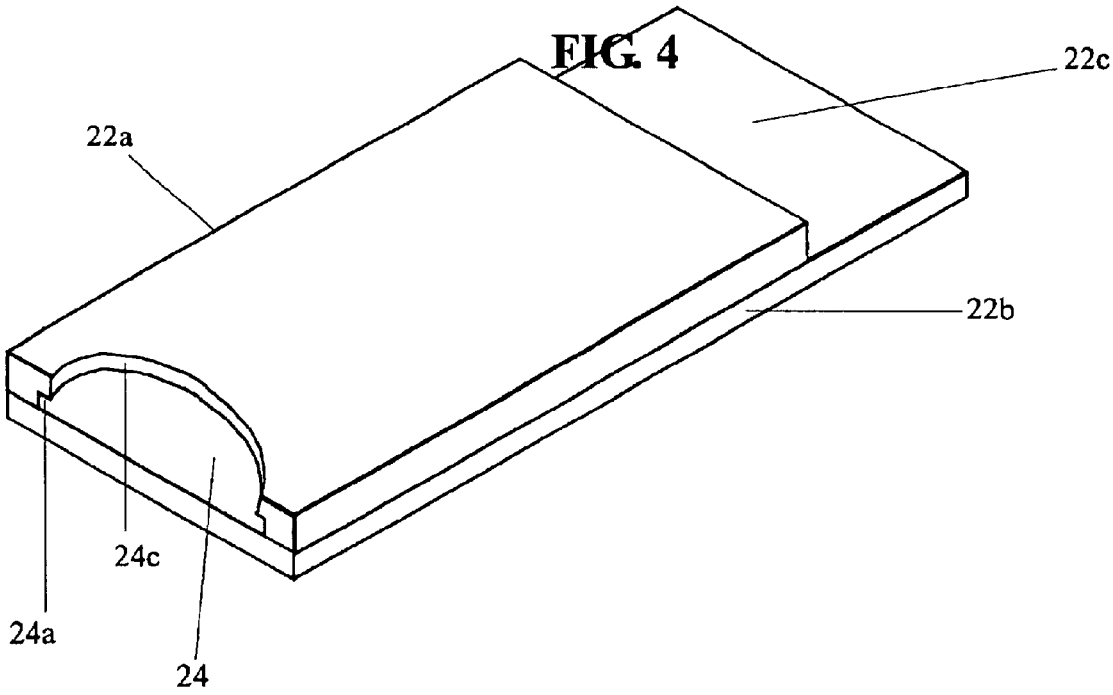
FIG. 4 illustrates a front perspective view of an alternate embodiment of the card read/write device of the present invention.
Figure 4A:
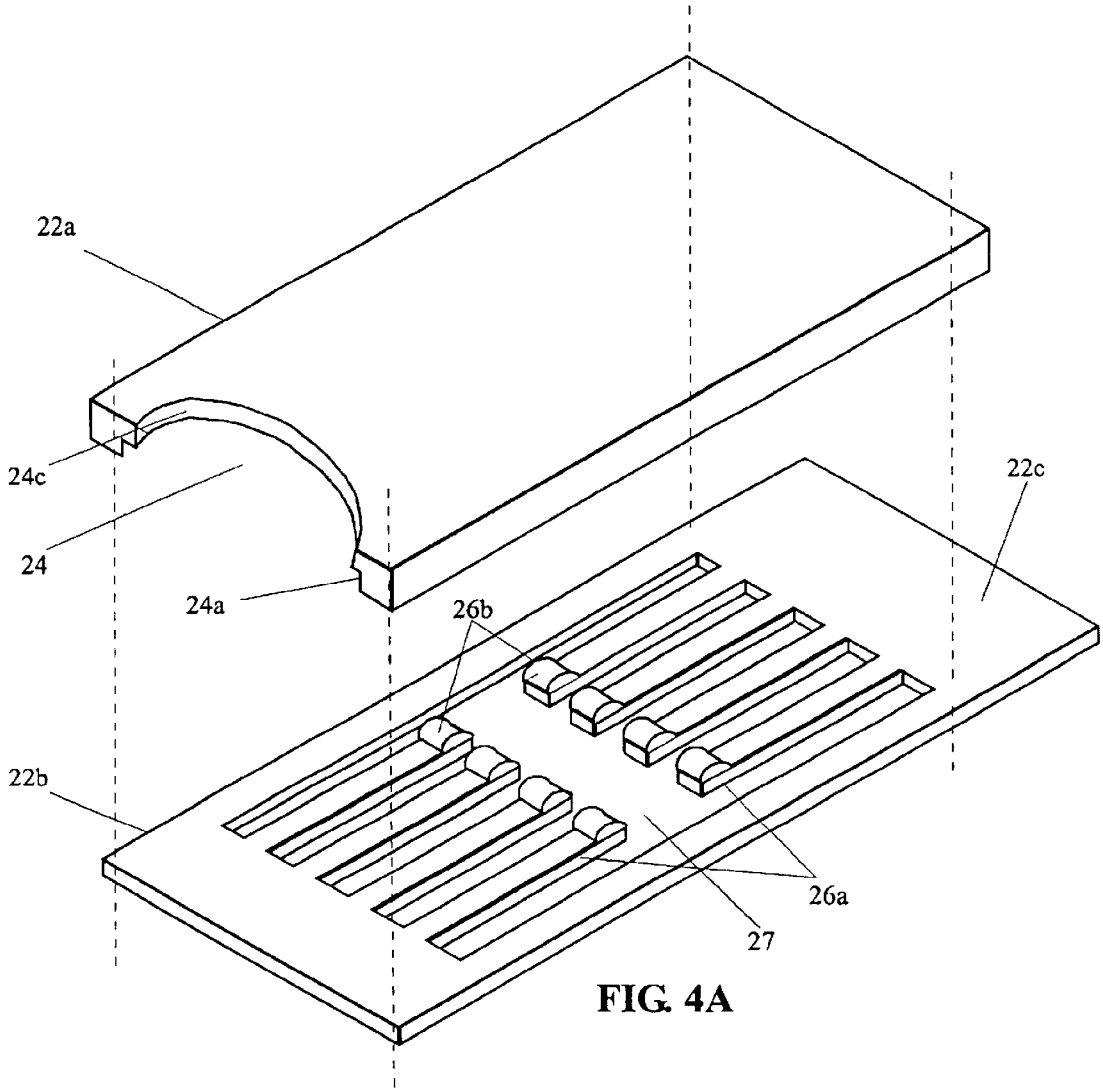
FIG. 4A illustrates an exploded front perspective view of the embodiment of the card read/write device of FIG. 4.
Figure 4B:
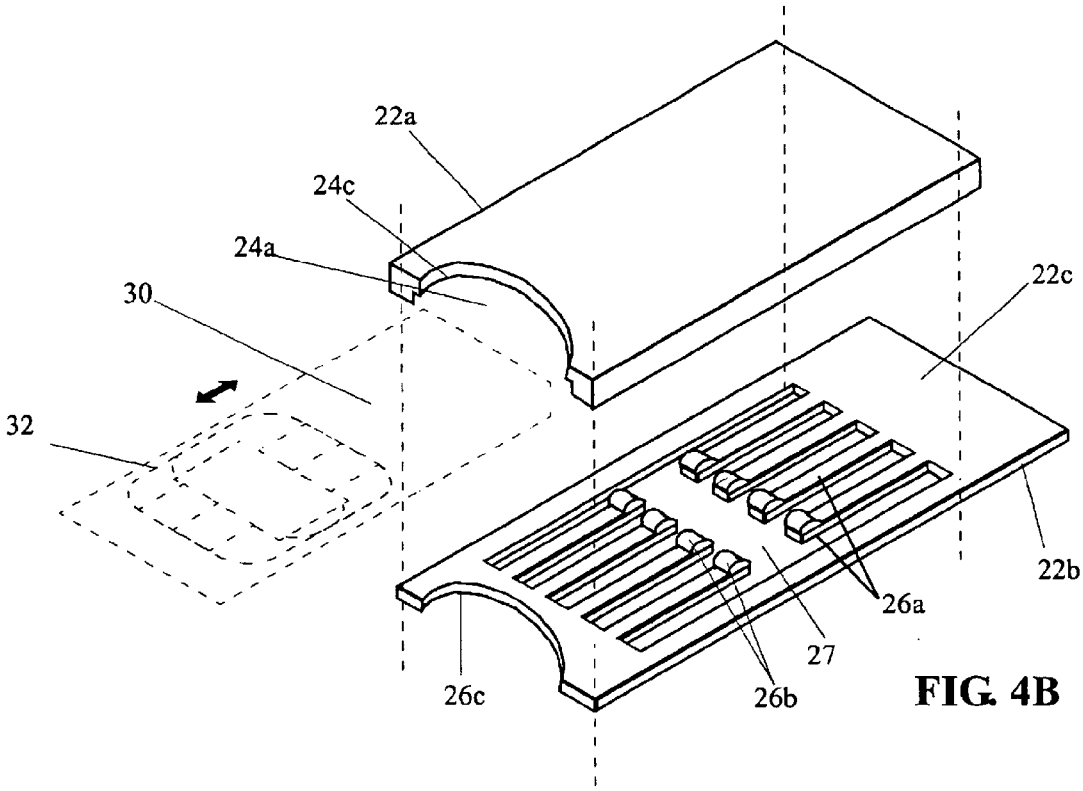
FIG. 4B illustrates an exploded front perspective view of an IC card being inserted into the card insertion slot of the embodiment of the present invention of FIG. 4.
Figure 4C:
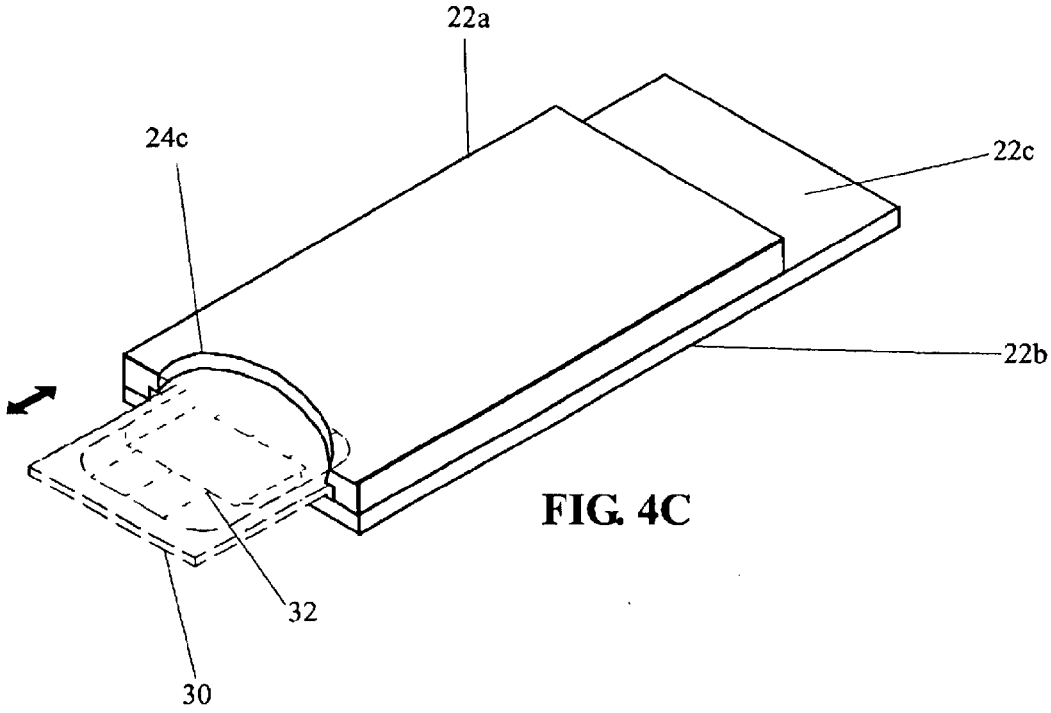
FIG. 4C illustrates a front perspective view of the embodiment of the present invention of FIG. 4 with an IC card partially inserted into the card insertion slot.

The portion of the PCB that are punched out to manufacture the embodiment of FIG. 2, can effectively be configured to function as the bottom PCB portion of another embodiment of the invention, that requires a smaller PCB area. One example of such a smaller embodiment of the invention is illustrated in FIG. 4 that shows an embodiment of the present invention that is adapted to establish communication with a SIM card.

The contact legs can be created in a plurality of ways. For example the area to be removed from the PCB can be cut out of the PCB using laser or water, it can be drilled out of the PCB, or 2 pieces of PCB can be joined together to create the same effect.

The contact heads 26*b* are created by integrating a convex shaped conductor with the PCB 22*b* at the open end of a contact leg 26*a*.

When connection is made between the contact head 26*b* and a card's contact pad 32, communication is established between the IC card and the electrical components of the PCB 22*b*.

In the preferred embodiment the area of the PCB 22*b* is larger than the area of the housing 22*a*, leaving space 22*c* on the PCB for the necessary electronic components uncovered. In alternative embodiments the housing also covers the electronic components of the PCB.

Figure 4D:
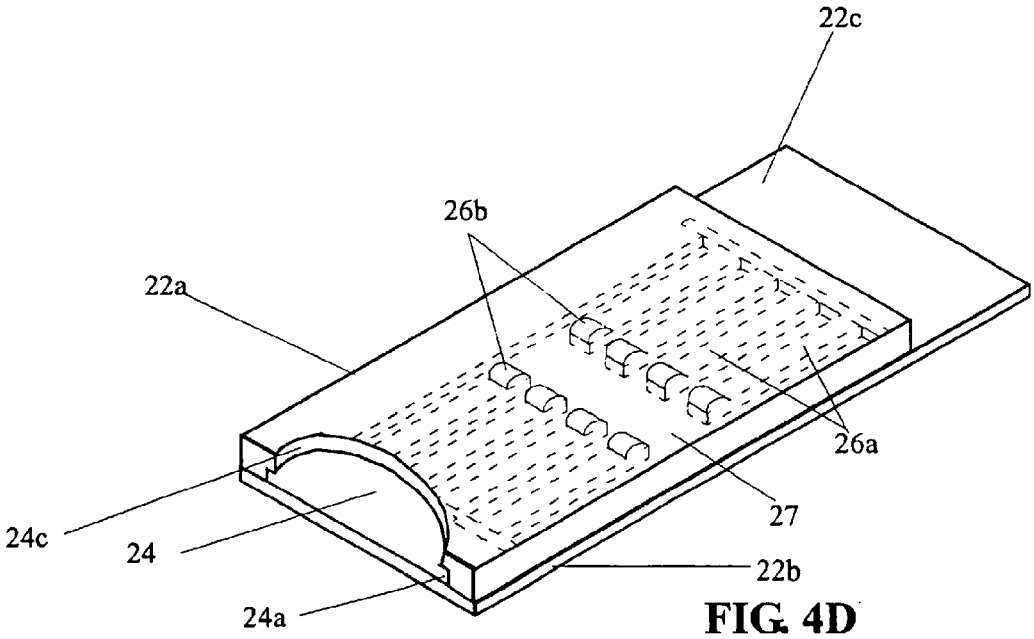
FIG. 4D illustrates a front perspective view of the alternate embodiment of the card read/write device of FIG. 4.

FIGS. 4–4D—Additional Embodiment

FIG. 4 illustrates an additional embodiment of the invention, where the connector has been adapted to communicate with a SIM card, of the type that is commonly used in cellular telephones.

The functionality of this embodiment of the invention is the same as described under the preferred embodiment of the invention.

To allow for easy insertion or extraction of an IC card, an optional half circle 24*c* and 26*c* can be cut out of the housing and the PCB respectively to allow 2 human (or mechanical) fingers to grab the card.

In this embodiment the available space on the PCB 22*c* for electronic components are placed behind the back end of the housing 22*a*, to allow the connector 20 to be narrow.

By changing the size and shape of the PCB and the housing, any desirable shape of the connector can be obtained. Examples of such alternative shapes are square, L-shaped and round.

Figure 5:
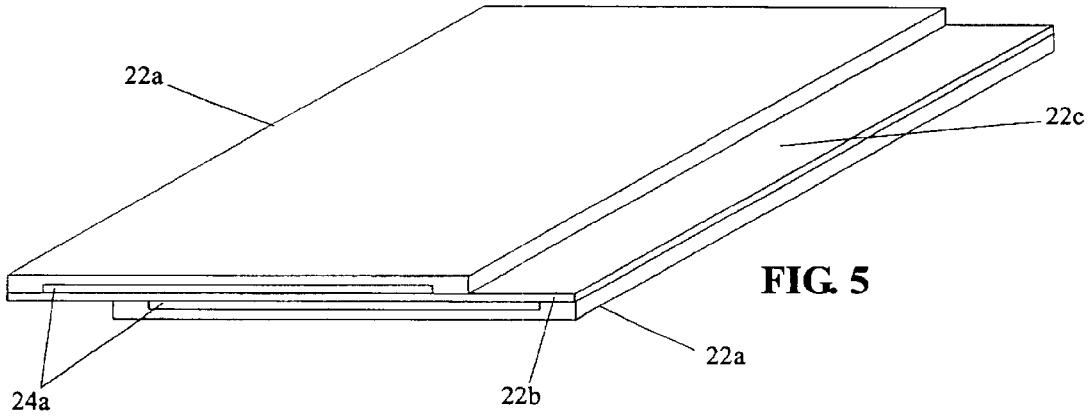
FIG. 5 illustrates a front perspective view of an alternate embodiment of the card read/write device of the present invention, that is adapted to have 2 cards inserted at the same time.
Figure 5A:
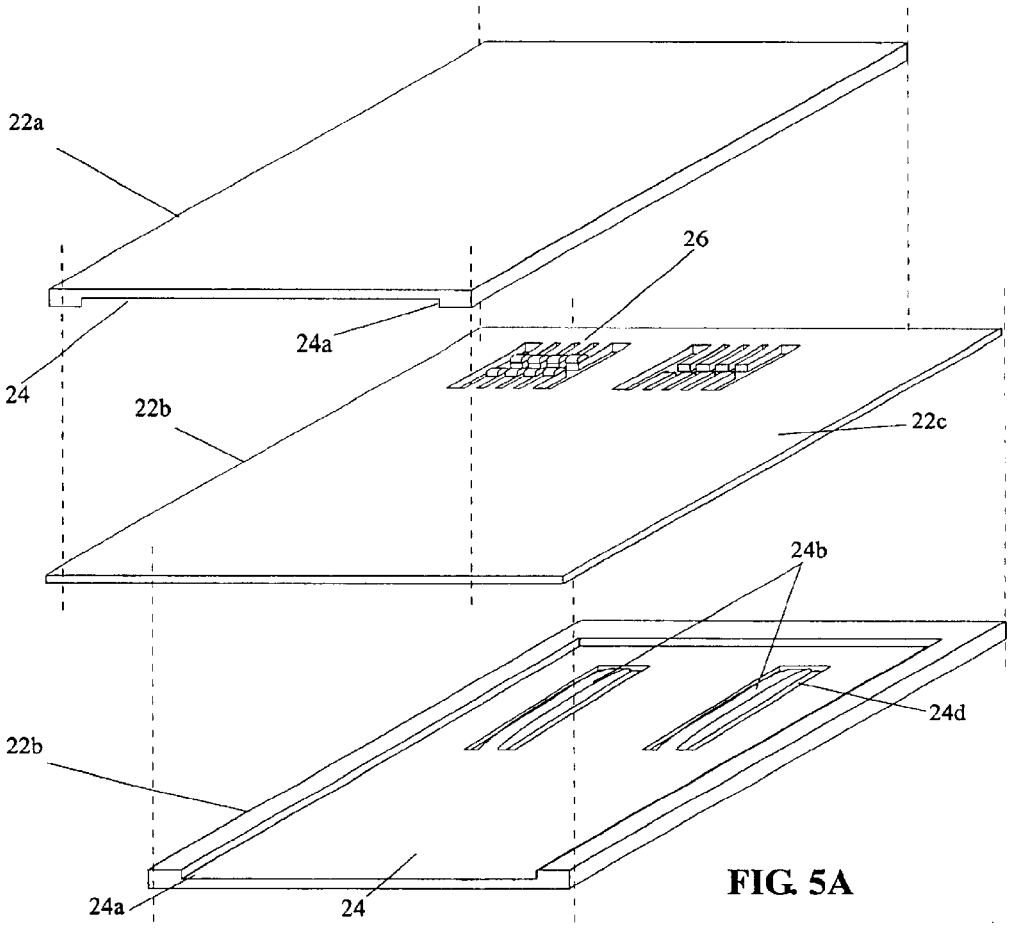
FIG. 5A illustrates an exploded front perspective view of the embodiment of the present invention of FIG. 5.

FIGS. 5–5A—Alternative Embodiment 1

FIG. 5 illustrates an alternate embodiment where the preferred embodiment of FIG. 2 has been adapted to communicate with 2 cards at the same time.

In this embodiment 2 separate sets of contacts (26.1 and 26.2) have been punched out of the same PCB 22*b*. On a first set of contacts 26.1, the contact heads have been attached to the side of the PCB facing the housing 22*a* above the PCB. On a second set of contacts 26.2 the contacts have been placed on the side of the PCB facing the housing below the PCB. Thus the contact heads of the second sets of contacts 26.2 are not visible in the illustration of FIG. 5A.

In the embodiment illustrated in FIG. 5, 2 different cards can be inserted into the connector in the same direction. A first card can be inserted above the PCB 22*b* with the first card's contact pad 32 facing downward. A second card will be inserted below the PCB with the second card's contact pad facing upward.

Figure 6:
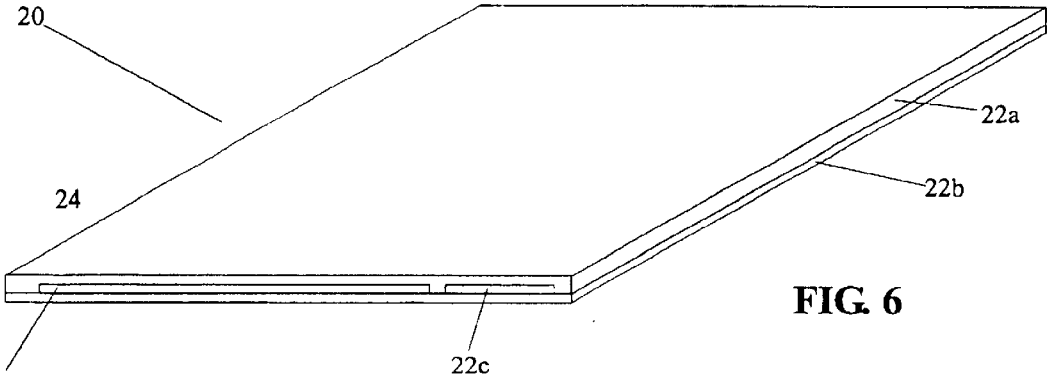
FIG. 6 illustrates a front perspective view of an alternate embodiment of the card read/write device of the present invention.

FIG. 6—Alternative Embodiment 2

FIG. 6 illustrates a moderation of the embodiment of the card read/write device of FIG. 2. In the embodiment of FIG. 6 the housing is made larger to cover the entire area of the PCB, thus providing protection for the electrical components that are integrated with the PCB.

Figure 7:
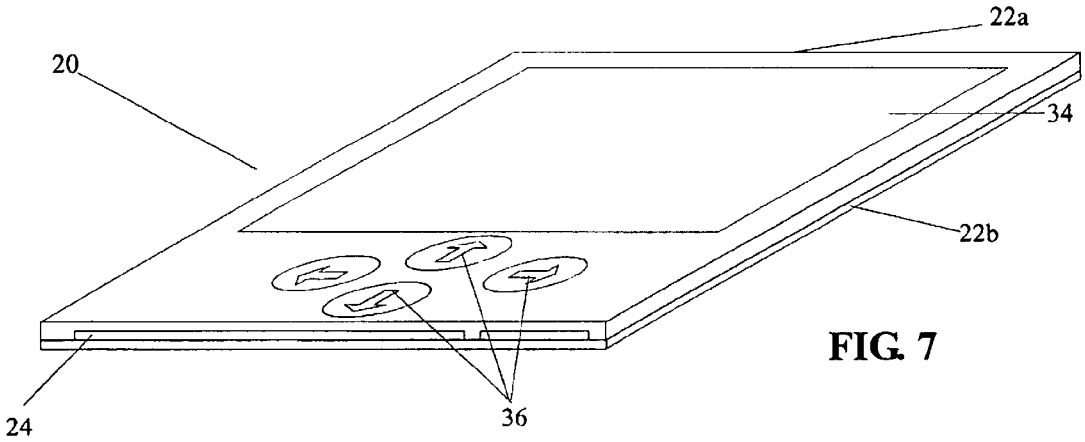
FIG. 7 illustrates a front perspective view of an alternate embodiment of the card read/write device of the present invention.
Figure 7A:
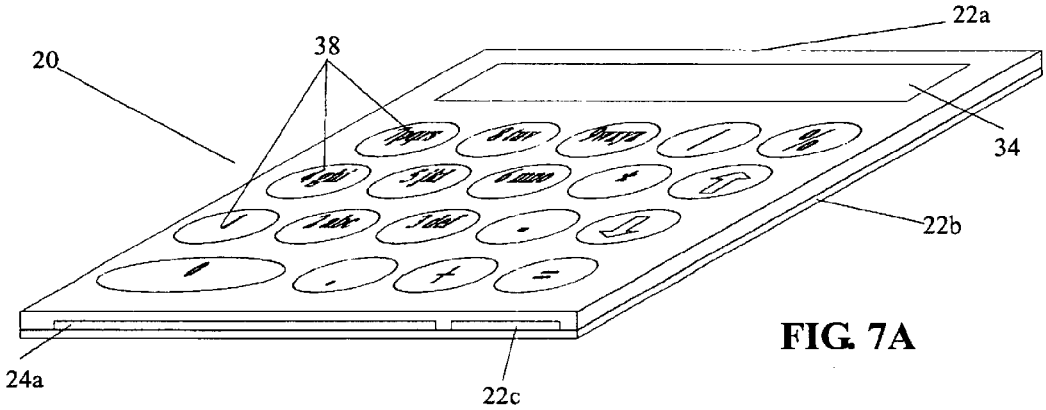
FIG. 7A illustrates a front perspective view of an alternate embodiment of the card read/write device of FIG. 7.

FIGS. 7–7A—Alternative Embodiment 3

The housing of the read/write device of the present invention can be manufactured in a number of suitable materials. Any hard material can be used. In addition other known devices of the prior art that can have a flat profile such as displays, keypads, fingerprint readers, a contact-less card read/write device, or a wireless communication device can easily be adapted to function as the housing of the present invention.

In FIG. 7 the housing is formed by a display for presentation of data to the user with integrated navigation buttons for scrolling through the presented data.

FIG. 7A illustrates a card read/write device of the present invention, where the housing is formed by a numerical keypad with integrated display.

Figure 8:
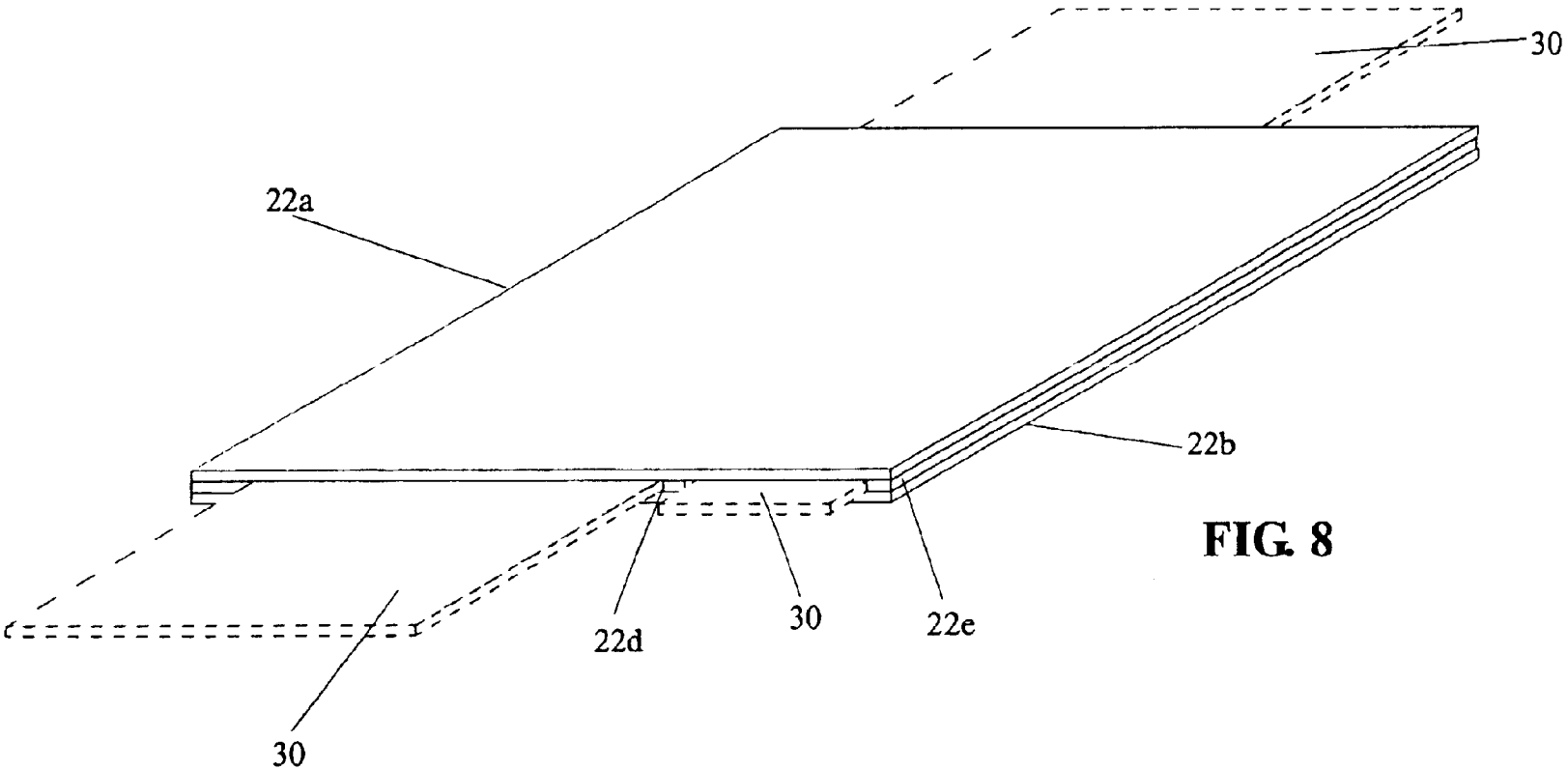
FIG. 8 illustrates a front perspective view of an alternate embodiment of the card read/write device of the present invention.
Figure 8A:
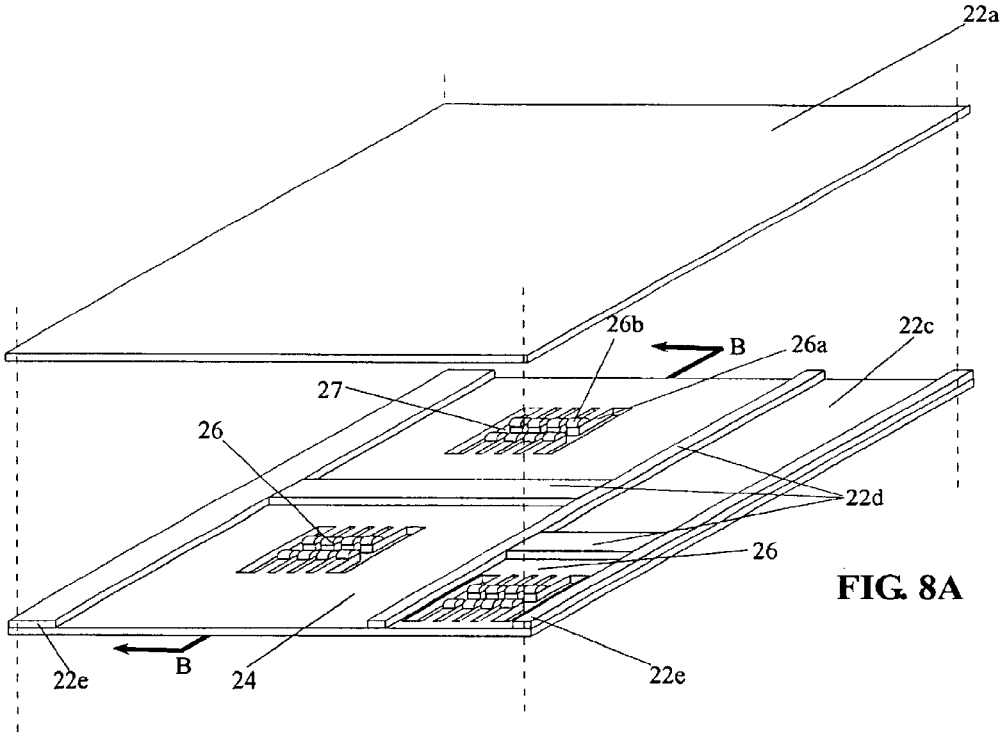
FIG. 8A illustrates an exploded front perspective view of the embodiment of the card read/write device of FIG. 8.
Figure 8B:
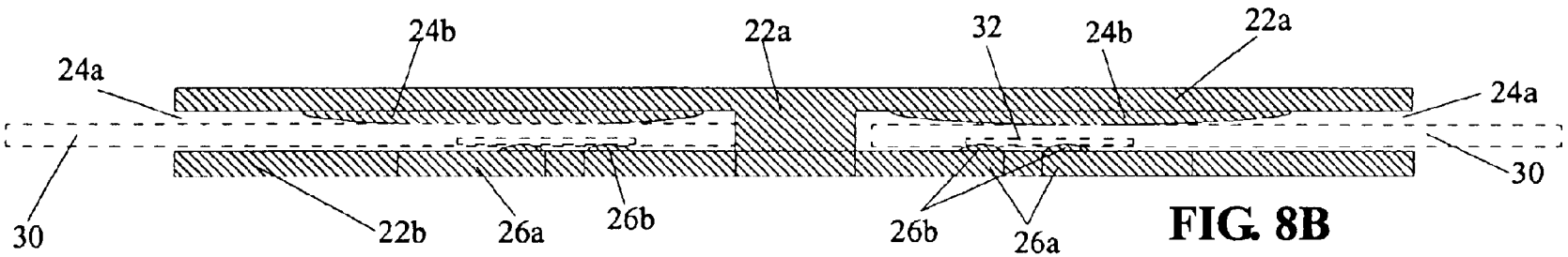
FIG. 8B illustrates a cross sectional view of an embodiment of the read/write device of FIGS. 8 and 8A with a card inserted, along line B—B of FIG. 8A.

FIGS. 8–8B—Alternative Embodiment 4

In another embodiment the connector could be configured to allow the insertion of 2 or more cards on the same side of the PCB 22*b* (for example the upper side as illustrated in FIG. 4), from any direction. FIG. 8 illustrates an embodiment of the invention, with 2 credit-card sized IC cards and 1 SIM card inserted into the read/write device. This embodiment allows a user to copy or transfer, for example, information or stored value from 1 card to another.

The multiple sets of contacts are manufactured by punching out 2 or more sets of contacts in the same PCB and placing the contact heads on the same side of the PCB.

The housing is configured to allow insertion of more than 1 card from different directions, by placing dividers between the PCB and the housing and not having an end edge on the housing.

In the embodiment of the present invention of FIGS. 8 and 8A the housing is formed as a lid that is placed above the PCB with dividers and pressure areas placed thereinbetween.

Figure 9:
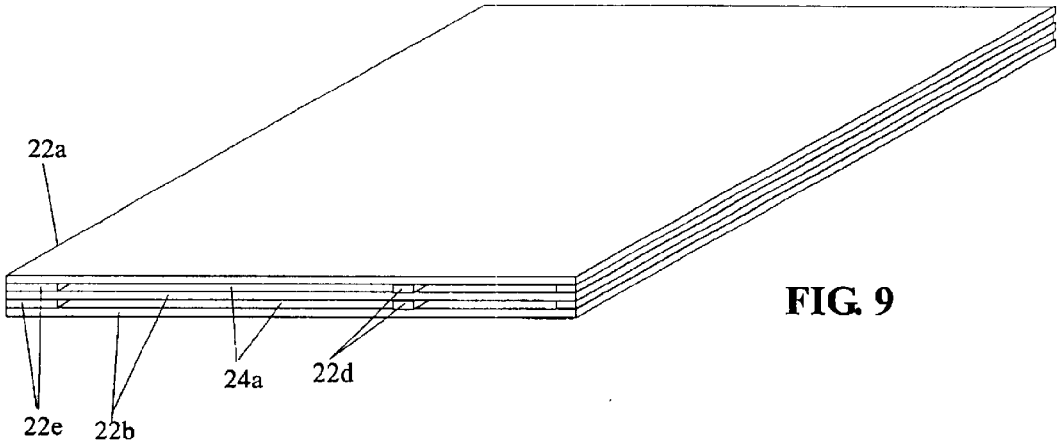
FIG. 9 illustrates a front perspective view of an alternate embodiment of the card read/write device of the present invention.
Figure 9A:
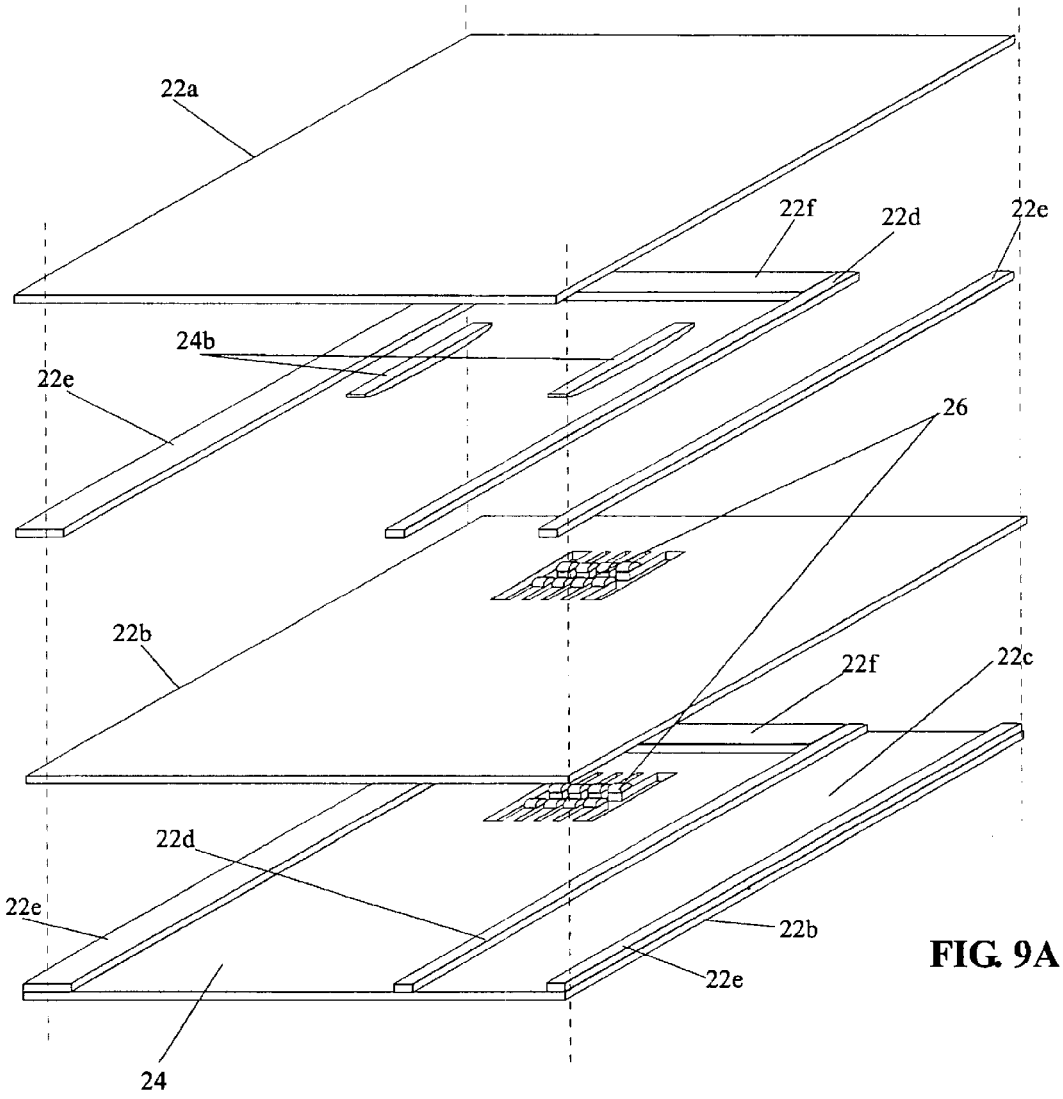
FIG. 9A illustrates an exploded front perspective view of the embodiment of the card read/write device of FIG. 9.

FIGS. 9–9A—Alternative Embodiment 5

In another embodiment of the present invention, the connector can be used to enable simultaneous communication with a plurality of IC cards 30 by using a second PCB 22*b* to function as the housing. This would in principle allow for simultaneous communication with an infinite number of IC cards. This embodiment of the invention could for example be used to simultaneously program or re-program a high number of IC cards.

Figure 10:
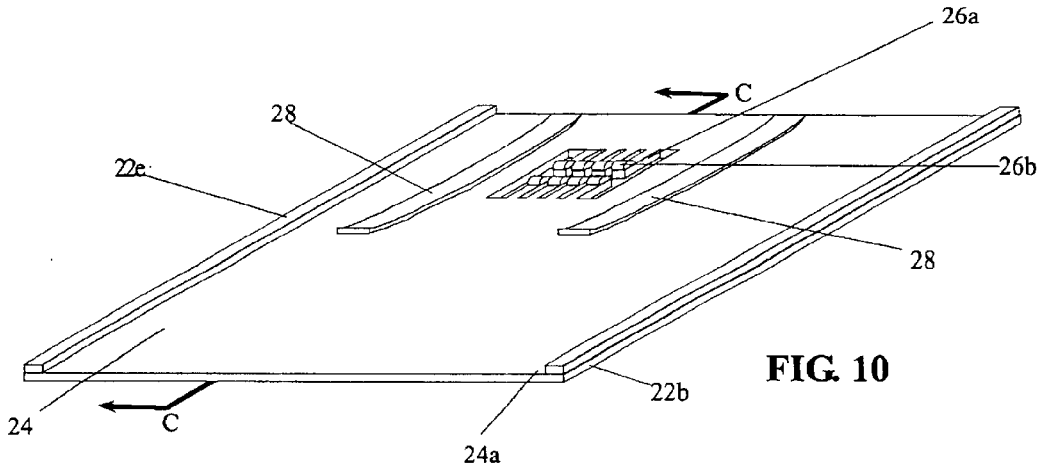
FIG. 10 illustrates a front perspective view of an alternative embodiment of the present invention.
Figure 10A:
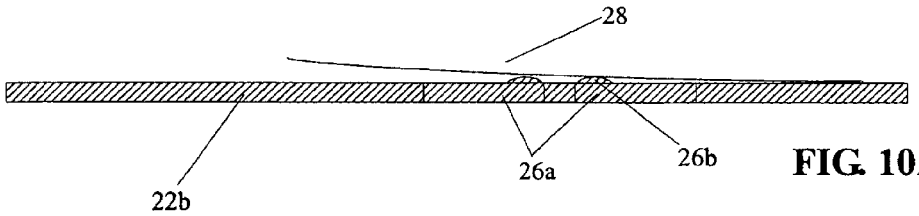
FIG. 10A illustrates a cross sectional view of the read/write device of FIG. 10 along line C–C.

FIGS. 10–10A—Alternative Embodiment 6

In situations where it is not desirable to place a closed housing above the PCB, one or more clips with a spring effect can be integrated into the PCB to apply the necessary pressure to an inserted card. FIGS. 10 and 10A illustrate one such embodiment, with guides placed along the edge of the PCB to hold the inserted card in place.

Figure 11A:
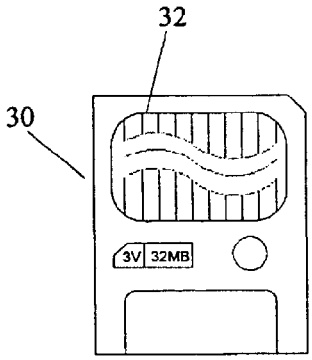
FIGS. 11A–11C illustrates a front side view of different types of contact IC cards.
Figure 11B:
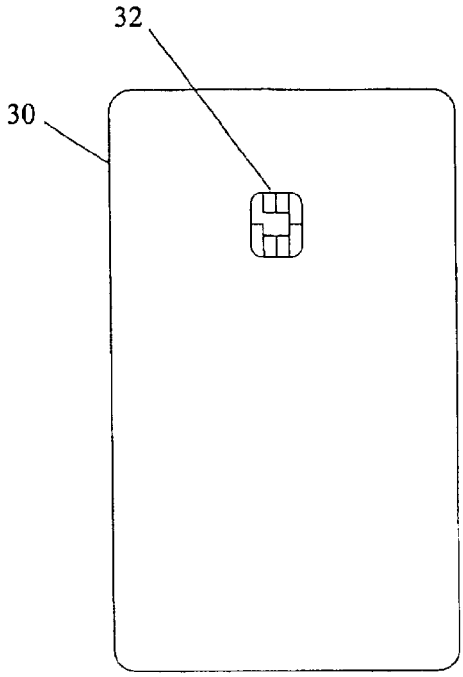
Figure 11C:
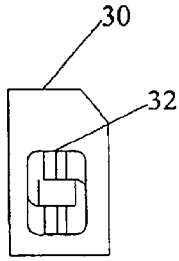

FIGS. 11A–11C—Examples of Different Contact IC Cards

FIG. 11A illustrates an IC card of the type commonly used in digital cameras.

FIG. 11B illustrates an IC card of credit-card size, commonly used as payment-, identification- and access cards.

FIG. 11C illustrates an IC card of the type commonly referred to as a SIM card, and commonly used in cellular phones and other portable communication devices.

Figure 12:
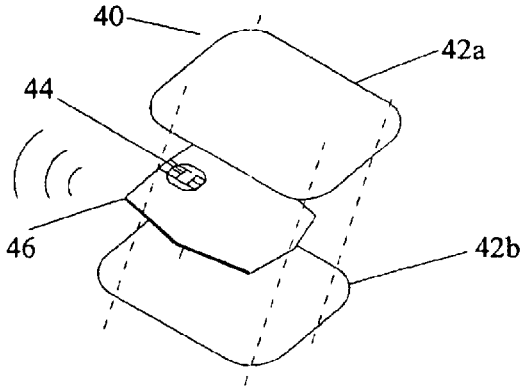
FIG. 12 illustrates an exploded front perspective view of a contact-less IC card.

FIG. 12—Examples of Contact-less IC Card

FIG. 12 illustrates an exploded view of a contact-less IC card. The illustrated card consist of a top layer of plastic (42*a*), a middle layer comprising a microcircuit (44) and an antenna (46), and a bottom layer of plastic (42B).

Figure 13:
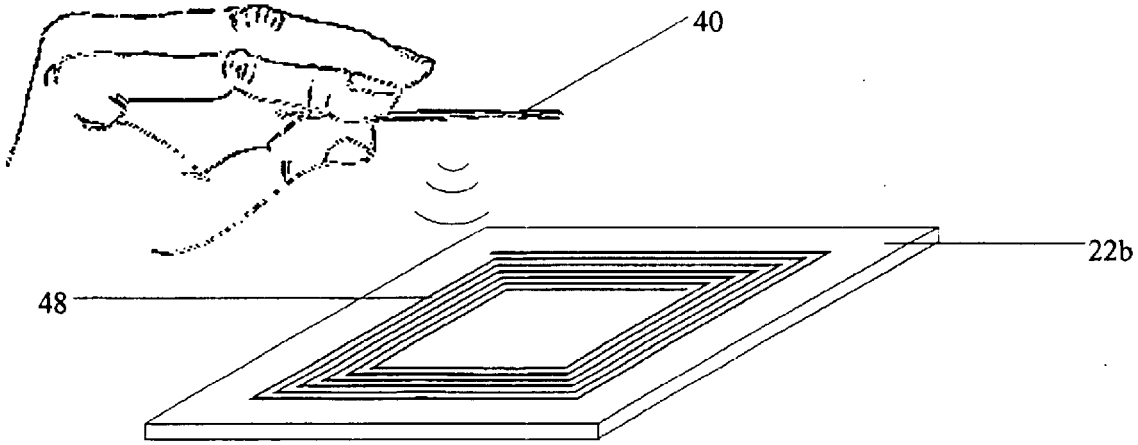
FIG. 13 illustrates a front perspective view of an alternative embodiment of the present invention.

FIG. 13—Alternate Embodiment 7 (Contact-less IC Card Read/Write Device)

In the embodiment illustrated in FIG. 13, the device is adapted to couple a contact-less IC card (40) to a conductive path (48) that is comprised in the PCB (22*b*).

A PCB traditionally comprises a conductive integrated circuit that is printed onto a board. By forming said integrated circuit according to the path 48 of FIG. 13, a conductive path is created that is completely flush with the PCB.

Figure 14:
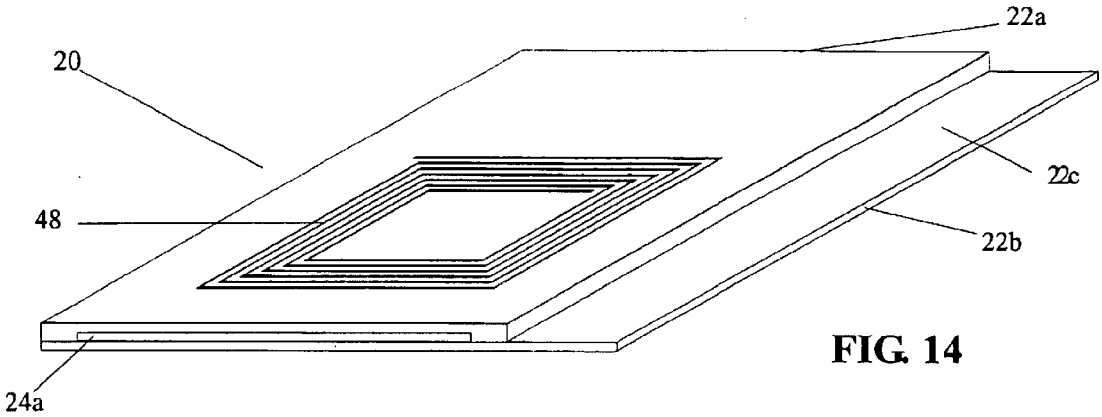
FIG. 14 illustrates a front perspective view of an alternative embodiment of the present invention.

FIG. 14—Alternate Embodiment 8

FIG. 14 illustrates an embodiment where the device is adapted to establish communication with both a contact IC card and a contact-less IC card.

Figure 15:
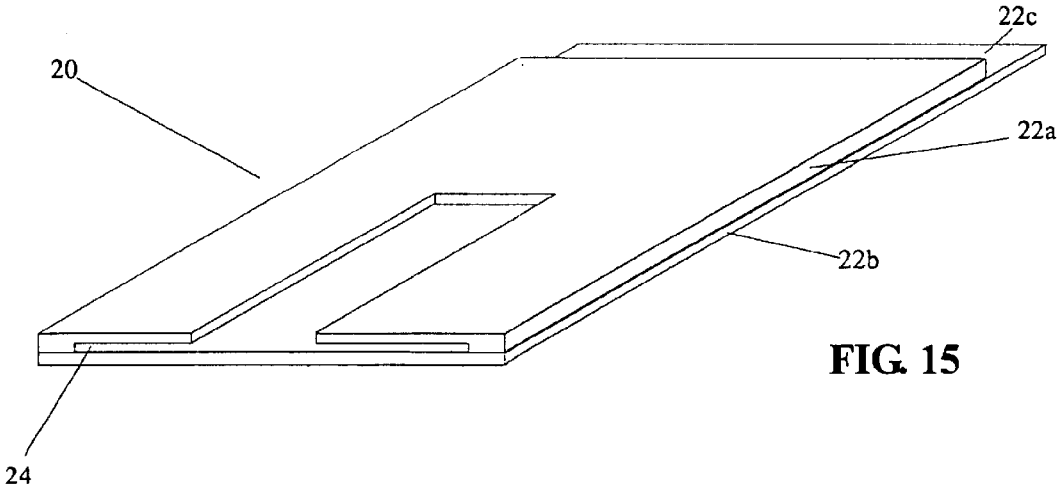
FIG. 15 illustrates a front perspective view of an alternative embodiment of the present invention.
Figure 16:
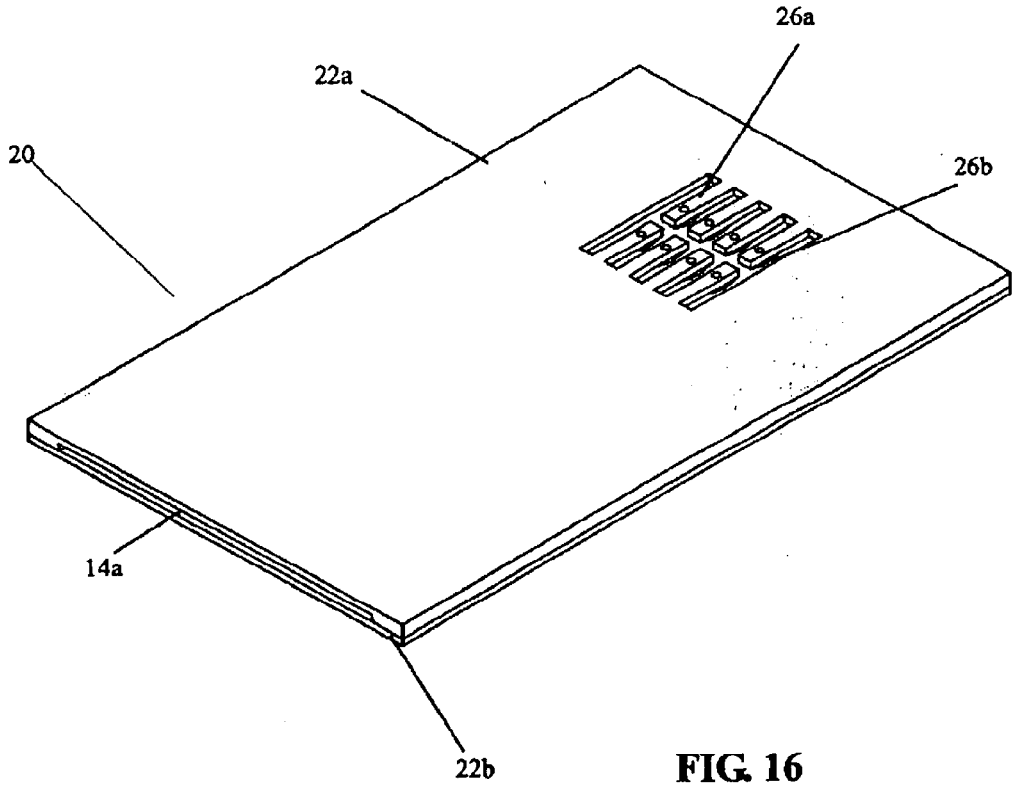
FIG. 16 illustrates a perspective view of the housing having integral contact legs.

FIG. 15—Alternate Embodiment 9

FIG. 15 illustrates an embodiment of the present invention, where the device is adapted to be a combination portable card read/write device and protective IC card cover. The bottom of the card read/write device 22*b* provide space 22*c* for comprising electronic components to couple an inserted card with a computing device, such as a personal computer, an identification device, a payment device or a ticketing device. The space 22*c* where electronic components are comprised, are preferably covered by the top of the housing, to provide protection to said electronic components. For illustrative purposes the housing of FIG. 15 is not covering the space 22*c* where the electronic components are comprised.

The card read/write device of FIG. 15 can communicate with said computing devices through various wireless technologies, for example Bluetooth or wireless network technology.

Optionally the embodiment of FIG. 15 can be equipped with a cable connector, to connect for example a USB cable, for other than wirelss communication.

In the embodiment of FIG. 15, the invention can also function as a IC card protecting case. The housing can for example be manufactured of hard plastic or PCB material, which will provide protection to an inserted card. By providing an opening in the housing 22*a*, an inserted card can conveniently be removed by pressing a finger against said card, and sliding the finger along the opening until the card is extracted from the card read/write device.

The embodiment of FIG. 15 is also very suitable for placement of advertising on the outer surface of both the top 22*a* and the bottom 22*b* of the housing.

The comers and edges can be rounded for greater comfort, for example for placement of the device in a pocket.

Conclusion, Ramifications and Scope

It is evident from the foregoing description that the present invention is useful for various applications wherein preservation of space above a PCB is allocated a high priority. The present invention does so without compromising valuable packaging areas or sacrificing sufficient electrical connection between the smart card and the PCB.

By comprising the contacts in the PCB, the connector of the present invention has a size that is significantly reduced from that of the prior art. For a smart card thickness of about 0.80 mm, the thickness of the connector, excluding the thickness of the PCB, is reduced from the prior approximately 2.5 mm to the present approximately 1.8 mm.

Additionally by comprising the contacts in the PCB the manufacture of card read/write device is made considerably simpler than the manufacture of connector contacts of the prior art.

While terms such as "above", "below", etc. are used to help describe the invention as it is illustrated, it should be understood that the connector can be used in any orientation. It is also possible to integrate the connector with other devices, to make the angle in which a card is inserted into the connector, adjustable by a user to anywhere between 0 and 180 degrees.

An end position switch can also easily be integrated into the present invention to detect if a card is fully inserted.

In any embodiment of the invention, where the PCB comprise more than 1 set of contacts, the contacts can optionally be configured differently to allow communication with cards of different standards (such as ISO or AFNOR).

In one alternative embodiment of the present invention the card read/write device are manufactured by punching out the contacts of the housing instead of the PCB, and using the PCB or any other material to apply pressure to an inserted card.

In yet another embodiment of the present invention the card read/write device is adapted to electrically couple a conductive RF signal path comprised in the PCB to a contact-less IC card.

Various changes to the foregoing described and shown methods and corresponding structures would now be evident to those skilled in the art. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector device having means for establishing contact to at least one contact pad of an integrated circuit card comprising:

a) a circuit board which comprises at least one electrical contact b) guiding means for guiding said integrated circuit card towards said circuit board in order to establish physical contact between said contact pad of said integrated circuit card and said set of electrical contacts c) said electrical contact comprising at least one contact leg formed integrally with, and.formed out of a single piece with said circuit board d) at least one contact head integrated with said contact leg formed of said circuit board.

2. A device according to claim 1 wherein said contact leg formed integrally with, and formed out of a single piece with said circuit board is flush with said circuit board.

3. A device according to claim 1 further comprising a flexible clip attached to said circuit board with said flexible clip having means for applying pressure to said IC card.

4. A device according to claim 1 further comprising a housing attached to said circuit board.

5. An electrical connector device having means for establishing contact to at least one contact pad of an integrated circuit card, comprising:

a) a housing which comprises at least one electrical contact b) a circuit board having means for attaching said housing thereto c) means for electrically coupling said housing and said circuit board e) guiding means for guiding said integrated circuit card towards said housing in order to establish physical contact between said contact pad of said integrated circuit card and said at least one electrical contact in said housing f) said electrical contact comprising at least one contact leg formed integrally with, and formed out of a single piece with said housing g) at least one contact head integrated with said contact leg formed integrally with, and formed out of a single piece with said housing.

6. A claim according to claim 5 wherein said contact leg formed integrally with, and formed out of a single piece with said housing is flush with said housing.

7. A device according to claim 4 or 5 wherein said housing and said circuit board form a card insertion ingress.

8. A connector device of claim 7 further comprising means for coupling said IC card with a computing device.

9. A connector device of claim 7 wherein said housing is formed of a device selected from the group consisting of:

displays displays with integrated cursor controls touch pads keypads calculators biometric authentication devices contact-less card read/write devices wireless communication devices a circuit board.

10. A connector device of claim 7 wherein said housing is formed of a material selected from the group consisting of:

plastic wood metal cardboard glass rubber foam.

11. A method for coupling an integrated circuit card and a circuit board comprising:

a) integrating into said circuit board coupling means for coupling said circuit board with said integrated circuit card b) making said coupling means flush with said circuit board c) forming said coupling means as at least one conductive contact d) attaching a housing to said circuit board c) forming a card insertion ingress between said circuit board and said housing f) providing means for applying pressure to an IC card inserted into said card insertion ingress g) forming at least one contact leg out of the same piece of material as the circuit board.

12. A method according to claim 11 further including integrating at least one contact head with said at least one contact leg.

13. A method for coupling an integrated circuit card and a circuit board comprising:

a) attaching a housing to said circuit board b) integrating into said housing coupling means for coupling said housing with said integrated circuit card c) making said coupling means flush with said housing d) forming said coupling means as a set of conductive contacts e) forming a card insertion ingress between said circuit board and said housing f) providing means for applying pressure to an IC card inserted into said card insertion ingress g) forming at least one contact leg out of the same piece of material as the housing h) providing means for electrically coupling said housing with said circuit board.

14. A method according to claim 13 further including integrating at least one contact head with said at least one contact leg.

* * * * *